US006731056B2

(12) United States Patent
Tojo et al.

(10) Patent No.: US 6,731,056 B2
(45) Date of Patent: May 4, 2004

(54) COLOR CATHODE RAY TUBE HAVING AN IMPROVED ELECTRON GUN

(75) Inventors: Tsutomu Tojo, Mobara (JP); Hiroyuki Tamura, Chiba (JP); Masayoshi Misono, Chiba-ken (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 0 days.

(21) Appl. No.: 10/073,186

(22) Filed: Feb. 13, 2002

(65) Prior Publication Data

US 2002/0074928 A1 Jun. 20, 2002

Related U.S. Application Data

(63) Continuation of application No. 09/702,654, filed on Nov. 1, 2000, now Pat. No. 6,348,759, which is a continuation of application No. 09/182,437, filed on Oct. 30, 1998, now Pat. No. 6,144,151.

(30) Foreign Application Priority Data

Oct. 30, 1997 (JP) ..... 9-298595

(51) Int. Cl.[7] ..... H01J 29/46; H01J 29/62

(52) U.S. Cl. ..... 313/414; 313/449

(58) Field of Search ..... 313/414, 410, 313/411, 409, 412, 413, 449, 458, 441; 315/1, 14, 382, 382.1

(56) References Cited

U.S. PATENT DOCUMENTS

| | | | | |
|---|---|---|---|---|
| 5,486,735 A | | 1/1996 | Kamohara et al. | 313/414 |
| 5,814,930 A | | 9/1998 | Watanabe et al. | 313/414 |
| 5,932,958 A | | 8/1999 | Watanabe et al. | 313/412 |
| 5,994,827 A | | 11/1999 | Kim et al. | 313/414 |
| 6,031,326 A | * | 2/2000 | Suzuki et al. | 313/414 |
| 6,046,537 A | | 4/2000 | Sukano | 313/414 |
| 6,144,151 A | | 11/2000 | Tojo et al. | 313/414 |
| 6,348,759 B1 | * | 2/2002 | Tojo et al. | 313/414 |
| 6,456,080 B1 | * | 9/2002 | Kim et al. | 324/404 |

FOREIGN PATENT DOCUMENTS

| | | | | |
|---|---|---|---|---|
| JP | 51-140428 | * | 12/1976 | H04N/5/68 |
| JP | 55-146847 | * | 11/1980 | H01J/29/48 |
| JP | 58-103752 | * | 6/1983 | H01J/29/50 |
| JP | 4-126342 | * | 4/1992 | H01J/29/50 |
| JP | 4-152834 A | * | 5/1992 | A01M/29/00 |

* cited by examiner

*Primary Examiner*—Ashok Patel
*Assistant Examiner*—Karabi Guharay
(74) *Attorney, Agent, or Firm*—Antonelli, Terry, Stout & Kraus, LLP

(57) ABSTRACT

A color cathode ray tube having at least an electron gun, constituted by a cathode for forming a plurality of electron beams arranged in-line, and a focusing electrode and an anode constituting a main lens for focusing and accelerating the electron beams and a fluorescent screen. The focusing electrode includes at least a first division electrode and a second division electrode arranged with a gap for controlling a scanning speed of the electron beams in common. The second division electrode is opposed to the anode and has, in an opposed surface thereof, a single opening for passing the plurality of electron beams in common. A length of the first division electrode in the axial direction of the tube is longer than a length of the second division electrode in the axial direction of the tube.

10 Claims, 7 Drawing Sheets

COLOR CATHODE RAY TUBE HAVING AN IMPROVED ELECTRON GUN

CROSS REFERENCE TO RELATED APPLICATION

This is a continuation of U.S. application Ser. No. 09/702,654, flied Nov. 1, 2000, now U.S. Pat. No. 6,348,759, which is a continuation of U.S. application Ser. No. 09/182,437, filed Oct. 30, 1998, now U.S. Pat. No. 6,144,151, the subject matter of which is incorporated by reference herein.

BACKGROUND OF THE INVENTION

The present invention relates to a color cathode ray tube and, particularly, to a color cathode ray tube having an electron gun that makes it possible to obtain favorable focusing characteristics over the whole fluorescent screen and that executes efficient speed modulation.

A technology for improving the picture quality of TV receivers and computer monitors can be represented by a method disclosed in Japanese Patent Laid-open No. 140428/1976, in which the scanning speed of the electron beam is modulated with a brightness-changing portion of the picture (or the image) to emphasize the contour of the picture. This method is generally called speed modulation.

Such speed modulation includes both an electromagnetic type and an electrostatic type. The speed modulation of the electromagnetic type, however, has been more generally used. The speed modulation of the electromagnetic type is produced by an electromagnetic coil attached around the neck portion of a cathode ray tube and a circuit for driving the electromagnetic coil.

FIG. 4 is a schematic sectional view illustrating a color cathode ray tube of the speed modulation type. In this color cathode ray tube, a vacuum enclosure is constituted by a panel portion 20, a neck portion 21 and a funnel portion 22. On the inner surface of the panel portion 20 there is formed a fluorescent screen 23 by arranging fluorescent materials of three colors in the form of a mosaic or stripes, and adjacent the back surface of the fluorescent screen 23 there is provided a shadow mask 24 which operates as a color-selection electrode. The shadow mask is held by a mask frame 25 and is supported together with a magnetic shield 26 on the inner surface of a skirt of the panel portion by a mask suspension mechanism 27. Furthermore, an electron gun 28 of an in-line type is contained in the neck portion 21, and a deflecting device 29 is so provided as to surround a transition region between the neck portion 21 and the funnel portion 22.

Reference numeral 30 denotes a magnetic device for correcting the color convergence and the color purity of the electron beam. An electromagnetic coil 34 for speed modulation is further provided around the neck portion 21.

Reference numeral 31 denotes stem pins for feeding image signals and various drive voltages to the electrodes of the electron gun, 32 denotes a getter for increasing the degree of vacuum, and 33 denotes a band for preventing implosion.

An electron beam B emitted from the electron gun is subjected to speed modulation by the magnetic field generated by the electromagnetic coil 34 surrounding the neck portion 21 to reproduce an image having a high picture quality on the fluorescent screen 23.

FIGS. 5A and 5B are diagrams illustrating the constitution of a conventional electron gun used for the color cathode ray tube shown in FIG. 4. FIG. 5A is a side view and FIG. 5B is an end view as seen in the direction indicated by arrow P in FIG. 5A.

The electron gun is constituted by a cathode 1, a first electrode 2, a second electrode 3, a third electrode 4, a fourth electrode 5, a fifth electrode (focusing electrode) 6, a sixth electrode (anode) 7, and a shield cup 8. Reference numeral 9 denotes bead glass for firmly holding the electrodes, 10 denotes a stem, and 11 denotes contact springs.

A shield cup 8 is connected to the anode 7 on the fluorescent screen side. Referring to FIG. 5B, openings 81, 82 and 83 are formed in line in the bottom of the shield cup 8 for the three electron beams.

The focusing electrode 6 is divided into two parts, i.e., a first division electrode 61 and a second division electrode 62 in the axial direction of the tube. The whole electrode has a length L in the axial direction of the tube, the first division electrode 61 having a length L1 in the axial direction of the tube, and the second division electrode 62 having a length L2 in the axial direction of the tube, satisfying the relation $L1 \leqq L2$.

FIGS. 6A and 6B are diagrams illustrating the constitution of the second division electrode constituting the focusing electrode of FIG. 5A. FIG. 6A is a front view as viewed from the anode 7 side, and FIG. 6B is a side view showing a portion thereof in cross section.

Openings 62*a*, 62*b* and 62*c* are formed in the second division electrode 62 on the first division electrode 61 side for the respective electron beams. A single opening 62*d* is formed in the surface thereof opposed to the anode, and it has a diameter D in a direction at right angles with the in-line direction. In the electrode there are further installed an inner electrode 64 and a plate-like correction electrode 63 having openings for the respective electron beams. Reference numeral 65 denotes tabs buried in the bead glass.

An electron gun having the above-mentioned electrode constitution is disclosed in Japanese Patent Laid-open Nos. 103752/1983 and 152834/1991.

The second division electrode 62 has a length L2 in the axial direction of the tube; the length from the surface thereof opposed to the first division electrode 61 to the electron beam passing opening in the inner electrode 64 is L21 in the axial direction of the tube; the length of the surface thereof opposed to the anode 7 to the electron beam passing opening in the inner electrode 64 is L22 in the axial direction of the tube; and the length from the surface thereof opposed to the anode 7 to the electron beam passing opening in the plate-like correction electrode 63 is L23 in the axial direction of the tube. Here, the length L21 is $L21 \geqq L22$.

The main lens of the electron gun is formed in a portion shown in FIG. 5A, where the anode 7 and the focusing electrode 6 are opposed to each other and the focusing electrode 6 is divided into two parts, i.e., the first division electrode 61 and the second division electrode 62 in the axial direction. The electric field produced by the electromagnetic coil surrounding the neck portion enters the electrodes through gaps among the main lens-forming portion, the first division electrode 61 and the second division electrode 62, and the electron beam passing through the main lens-forming portion and the two division electrodes is temporarily deflected by the magnetic field to control the scanning speed of the electron beam, i.e., to effect a so-called speed modulation.

The magnetic field generated by the electromagnetic coil forms eddy currents in the electrodes of the electron gun to suppress the action of speed modulation.

In order that the action of speed modulation is not suppressed by the eddy currents produced in the electrodes of the electron gun due to the magnetic field established by the electromagnetic coil, Japanese Patent Laid-open No. 146847/1980 discloses a method according to which a slit of a relatively broad width is formed in the electrodes of the electron gun at a position where the electromagnetic coil is installed.

In the above-described device, however, the electrodes for speed modulation are formed in the shape of a relatively deep box, and the gap (slit) formed between the electrodes is located relatively far away from the position of the main lens (focusing gap) toward the cathode. From the standpoint of the overall length of the electron gun, as well as the cathode ray tube, however, this structural arrangement is not suited for shortening the depth of current TVs and monitors. Besides, no consideration has been given at all concerning the efficiency of speed modulation.

SUMMARY OF THE INVENTION

According to the study conducted by the present inventors, it has been found that the effect of speed modulation can be enhanced in an electron gun having a structure as above-mentioned by contriving the position of the gap between the electrodes.

The object of the present invention is to provide a color cathode ray tube having favorable focusing characteristics over the whole fluorescent screen by efficiently executing speed modulation.

According to the present invention, the above-mentioned object is accomplished by setting up a predetermined relationship between the length of the electrode having a single opening and constituting the main lens in the axial direction of the tube and the diameter of the single opening in a direction at right angles with the in-line direction.

That is, the present invention has the below-mentioned features.

(1) A color cathode ray tube comprising at least an electron gun, constituted by a cathode for forming a plurality of electron beams arranged in line and a plurality of electrodes, and a fluorescent screen, wherein the plurality of electrodes including an anode are arranged in the axial direction of the tube and have dissimilar potentials, and a main lens is constituted of the anode and another electrode neighboring the anode, the electrode neighboring the anode includes at least two division electrodes having the same potential arranged with a gap in the axial direction of the tube, and one of the division electrodes is opposed to the anode and has, in the opposed surface thereof, a single opening for passing the plurality of electron beams in common, and the one division electrode opposed to the anode has a length in the axial direction of the tube that is from about 1.0 to about 1.6 times as great as the diameter of the single opening in a direction at right angles with the in-line direction.

(2) A color cathode ray tube comprising at least an electron gun, constituted by a cathode for forming a plurality of electron beams arranged in line and a plurality of electrodes, and a fluorescent screen, wherein the plurality of electrodes including an anode are arranged in the axial direction of the tube and have dissimilar potentials, and a main lens is constituted of the anode and another electrode neighboring the anode, the electrode neighboring the anode includes at least a first division electrode and a second division electrode having the same potential and arranged with a gap in the axial direction of the tube, and the second division electrode is opposed to the anode and has, in the opposing surface thereof, a single opening for passing the plurality of electron beams in common, and the length of the first division electrode in the axial direction of the tube is longer than the length of the second division electrode in the axial direction of the tube, and the length of said second division electrode in the axial direction of the tube is from about 1.0 to about 1.6 times as great as the diameter of the single opening in a direction at right angles with the in-line direction.

(3) A color cathode ray tube comprising at least an electron gun, constituted by a cathode for forming a plurality of electron beams arranged in line, a focusing electrode, and an anode constituting a main lens for focusing and accelerating the electron beams, and a fluorescent screen, wherein the focusing electrode and the anode are arranged with a gap in order from the cathode side toward the fluorescent screen side in the axial direction of the tube, the focusing electrode is constituted by at least two division electrodes having the same potential along the axis of the tube to form at least one gap, and one of said electrodes is opposed to the anode and has, in the opposed surface thereof, a single opening for passing the plurality of electron beams in common, and the division electrode opposed to the anode has a length in the axial direction of the tube that is from about 1.0 to about 1.6 times as great as the diameter of the single opening in a direction at right angles with the in-line direction.

(4) A color cathode ray tube described in item (1), (2) or (3), wherein at least two independent electron beam passing openings in the axial direction of the tube for the plurality of electron beams emitted from the cathode are provided in the one division electrode having the single opening and opposed to the anode within a range of about 1.6 times of the diameter of the single opening in the direction at right angles with the in-line direction.

(5) A color cathode ray tube described in item (1), (2) or (3), wherein a shield cup is connected to the fluorescent screen side of the anode, and the electron beam passing opening formed on the cathode side of the shield cup is a single opening having a diameter that is elongated in the in-line direction.

(6) A color cathode ray tube described in item (1), (2) or (3), wherein a shield cup is connected to the fluorescent screen side of the anode, and the electron beam passing openings formed on the cathode side of the shield cup are independent openings having a diameter long in the in-line direction for the respective electron beams arranged in the in-line direction.

Owing to the above-mentioned features, speed modulation is efficiently executed, and favorable focusing characteristics are obtained over the whole fluorescent screen.

DETAILED DESCRIPTION OF THE PREFERRED EMBODIMENTS

An embodiment of the present invention will now be described in detail with reference to various embodiments.

Figure 1A:
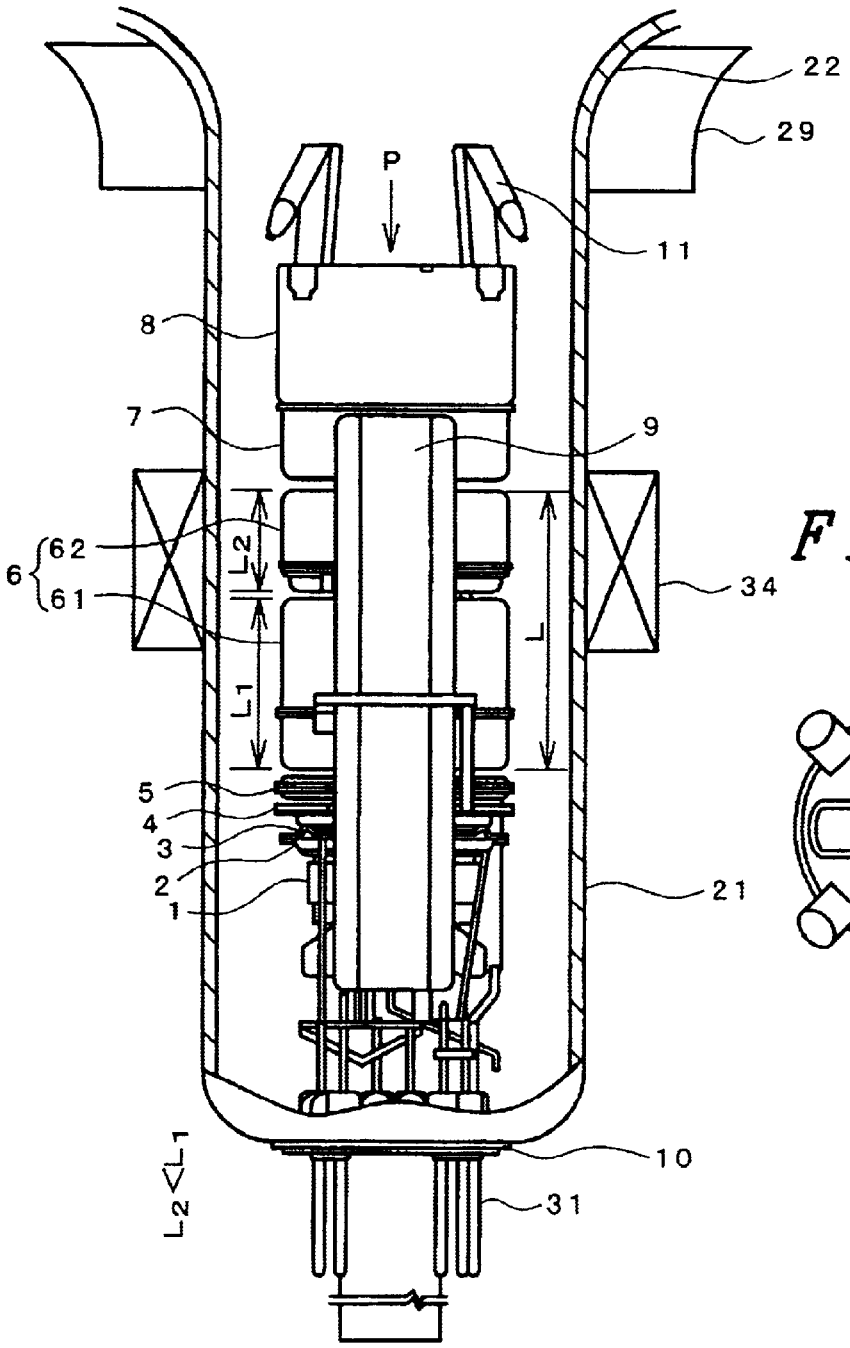
FIGS. 1A and 1B are diagrams illustrating an embodiment of an electron gun used for a color cathode ray tube of the present invention with FIG. 1C illustrating another embodiment.
Figure 1B:
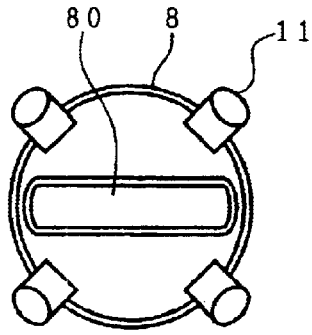

FIGS. 1A and 1B are diagrams illustrating an embodiment of an electron gun used for a color cathode ray tube according to the present invention. FIG. 1A is a side view and FIG. 1B is an end view as seen in the direction indicated by arrow P in FIG. 1A.

Figure 4:
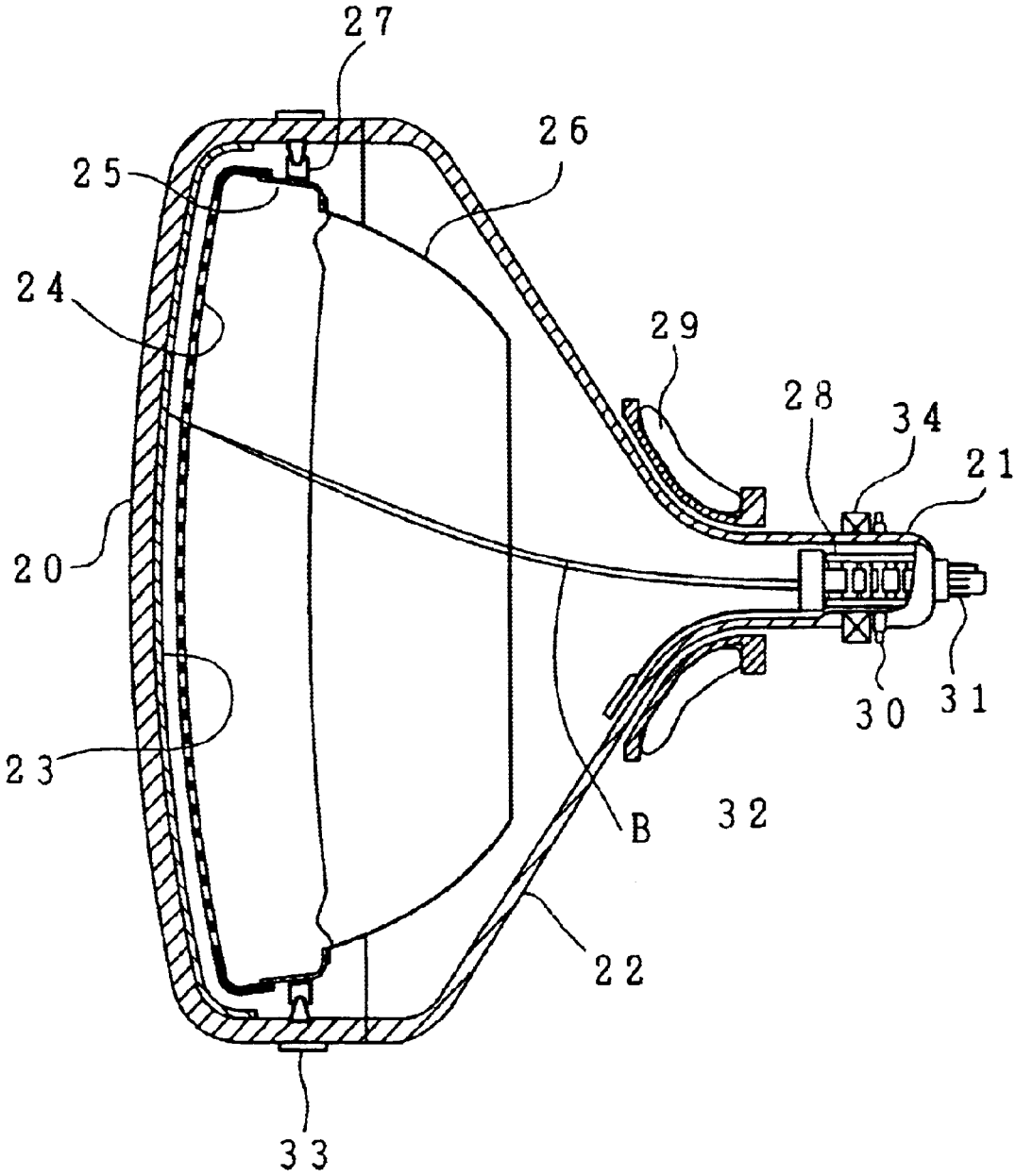
FIG. 4 (PRIOR ART)
FIG. 4 is a sectional view schematically illustrating the constitution of the color cathode ray tube of the speed modulation type.

The electron gun is contained in the neck portion 21 of the vacuum enclosure. Like the electron gun shown in FIGS. 5A and 5B, the electron gun is constituted by a cathode 1, a first electrode 2, a second electrode 3, a third electrode 4, a fourth electrode 5, a fifth electrode (focusing electrode) 6, a sixth electrode (anode) 7, and a shield cup 8. Reference numeral 9 denotes a bead glass for firmly holding the electrodes, 10 denotes a stem, and 11 denotes contact springs, and a deflecting device surrounds a transition region between the neck portion 21 and the funnel portion 22 of the vacuum enclosure in the manner of FIG. 4

Figure 2A:
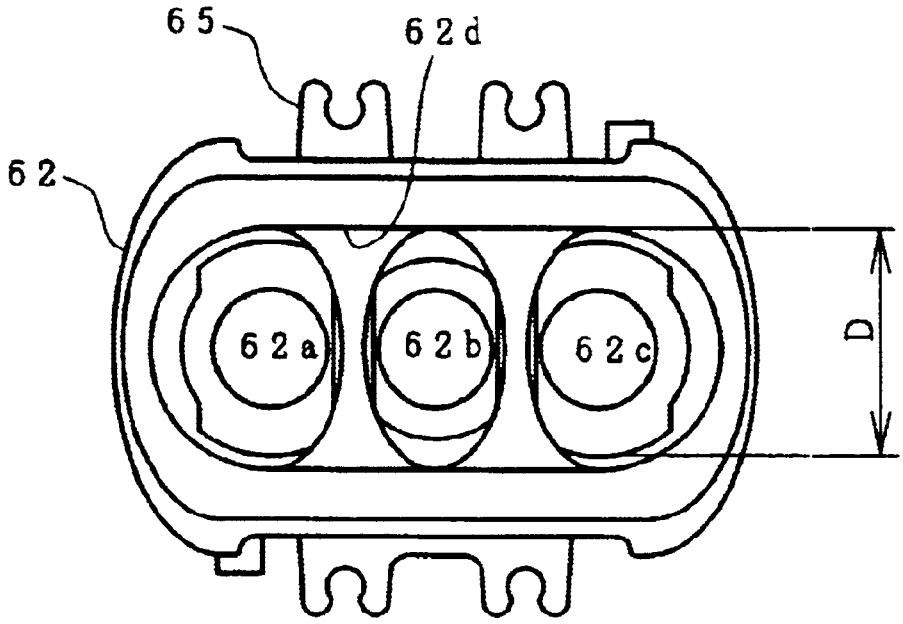
FIGS. 2A and 2B are diagrams illustrating the constitution of a second division electrode constituting a focusing electrode.
Figure 2B:
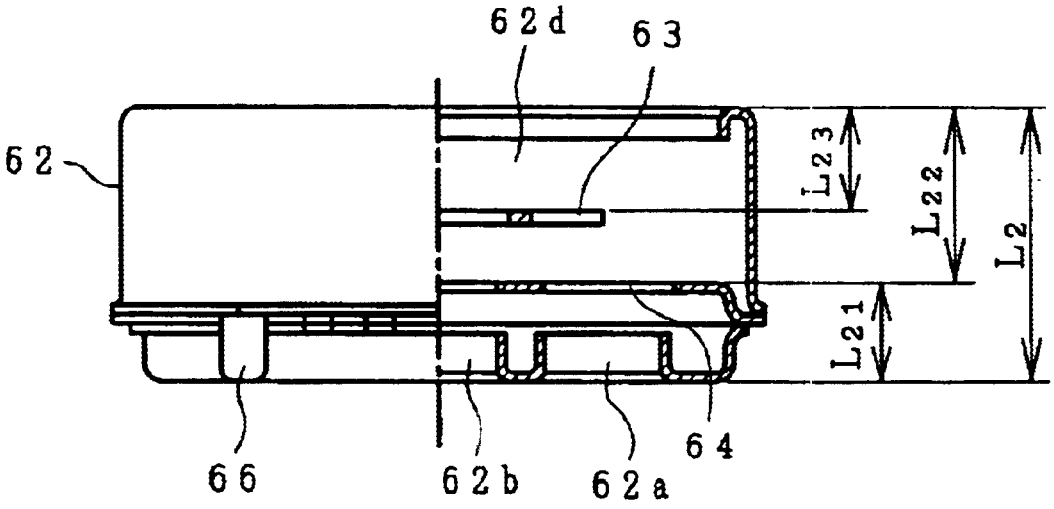

FIGS. 2A and 2B are diagrams illustrating the second division electrode constituting the focusing electrode of FIG. 1A, wherein FIG. 2A is a front view from the side of the anode 7 and FIG. 2B is a side view thereof in a partly cut-away manner.

In FIG. 1A, a shield cup 8 is connected to the anode 7 to which a voltage of 25 to 35 kV is applied on the fluorescent screen side. Referring to FIG. 1B, a single opening 80 is formed in the bottom of the shield cup 8 to pass three electron beams in common, the single opening 80 having a major axis in the in-line direction.

The focusing electrode 6 is divided into two parts, i.e., a first division electrode 61 and a second division electrode 62 arranged in the axial direction of the tube. The length of the whole electrode in the axial direction of the tube is L, the length of the first division electrode 61 in the axial direction of the tube is L1 and the length of the second division electrode 62 in the axial direction of the tube is L2. The length L is apportioned as L1≧L2.

The second division electrode 62 has circular openings 62*a*, 62*b* and 62*c* formed on the first division electrode 61 side for the respective electron beams, and has a single opening 62*d* in the surface thereof opposed to the anode, the single opening 62*d* has a diameter D in a direction perpendicular to the in-line direction. The electrode 62 further includes therein a plate-like correction electrode 63 and an inner electrode 64 having openings for the respective electron beams. Reference numeral 65 denotes tabs buried in the bead glass.

The length of the second division electrode 62 is L2 in the axial direction of the tube; the length from the surface thereof opposed to the first division electrode 61 to the electron beam passing openings of the inner electrode 64 is L21 in the axial direction of the tube; the length from the surface thereof opposed to the anode 7 to the electron beam passing openings of the inner electrode 64 is L22 in the axial direction of the tube; and the length from the surface thereof opposed to the anode 7 to the electron beam passing openings of the plate-like correction electrode 63 is L23 in the axial direction of the tube. The length L2 is apportioned as L21≦L22.

The main lens of the electron gun is formed in a portion where the anode 7 and the focusing electrode 6 are opposed to each other, as shown in FIG. 1A. The focusing electrode 6 is constituted by the first division electrode 61 and the second division electrode 62 divided into two parts in the axial direction of the tube. The magnetic field generated by the electromagnetic coil 34 surrounding the neck portion 21 of the vacuum enclosure enters, the electrode through gaps among the main lens-forming portion, the first division electrode 61 and the second division electrode 62 to effect speed modulation.

In FIGS. 1A, 2A, and 2B, the second division electrode 62 of the focusing electrode 6 and the anode 7 constituting the main lens of the electron gun, have a single opening common for the plurality of electron beams and independent openings for the respective electron beams. Like the one shown in FIGS. 6A and 6B, furthermore, the second division electrode 62 includes, therein, the plate-like correction electrode 63 having independent openings for the respective electron beams and the inner electrode 64 having independent openings for the respective electron beams.

The first division electrode 61 and the second division electrode 62 have an equal potential and are supplied with a focusing voltage of from 6 to 10 kV. The total length L of the two division electrodes 61 and 62 of the focusing electrode with a gap between them in the axial direction of the tube is the same as that of the conventional electron gun shown in FIGS. 5A, 6A and 6B. The electron beam passing openings formed in the opposed surfaces of the first division electrode 61 and the second division electrode 62 have a diameter of about 4 mm.

The electron gun is different from the conventional electron gun shown in FIGS. 5A, 5B, 6A and 6B in regard to the lengths of the first division electrode 61 and the second division electrode 62 formed by dividing the focusing electrode 6 in the axial direction of the tube.

Figure 6A:
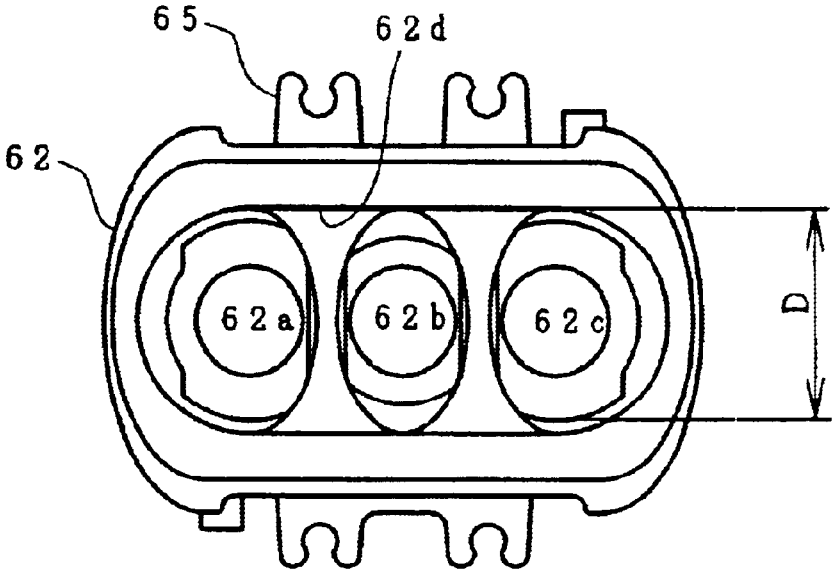
FIG. 6A (PRIOR ART)
FIGS. 6A and 6B are diagrams illustrating the constitution of a second division electrode constituting a focusing electrode of FIG. 5A.
Figure 6B:
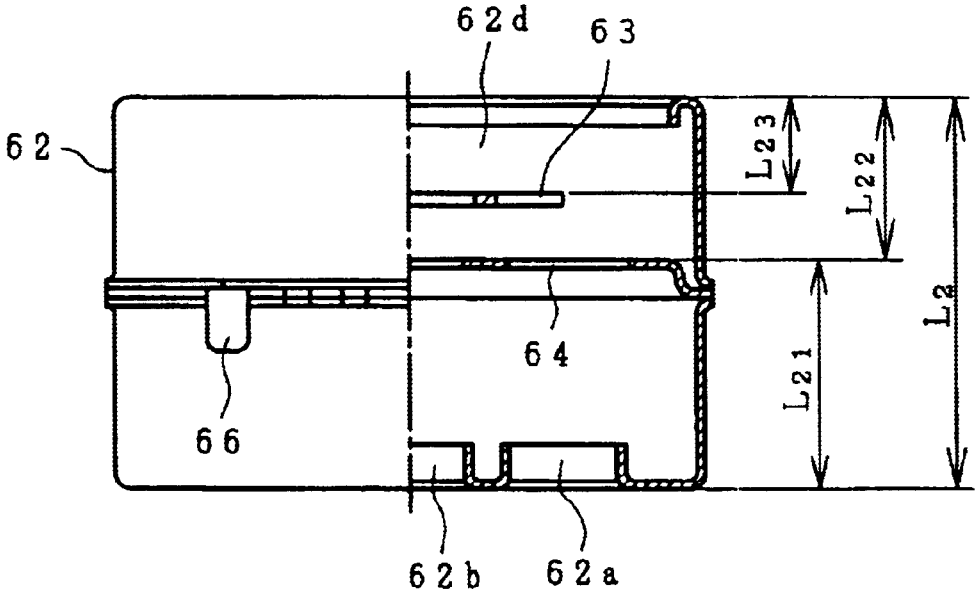
FIG. 6B (PRIOR ART)

In particular, the length L2 of the second division electrode 62 is about 1.2 times as great as the diameter D of the single opening 62*d* in a direction at right angles with the in-line direction. In the conventional electron gun as shown in FIGS. 6A and 6B, this ratio is about 1.8 times.

The speed-modulation coil is installed surrounding the neck portion 21 of the vacuum enclosure extending across the first division electrode 61, second division electrode 62 and the anode 7.

Figure 5A:
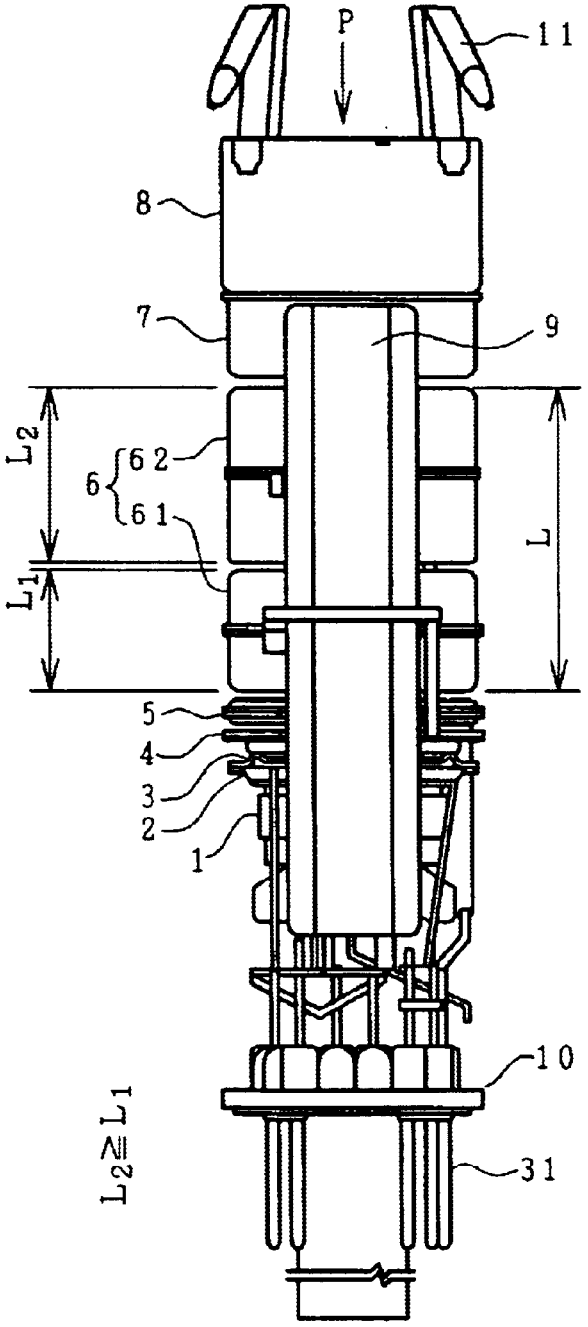
FIG. 5A (PRIOR ART)
FIGS. 5A and 5B are diagrams illustrating the constitution of a conventional electron gun used for the color cathode ray tube shown in FIG. 4.
Figure 5B:
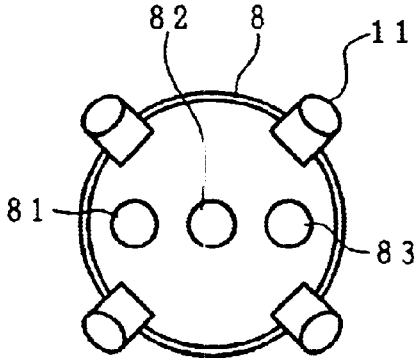
FIG. 5B (PRIOR ART)

In the conventional electron gun shown in FIGS. 5A and 5B, the main lens electric field established by the anode voltage applied to the anode 7 and by the focusing voltage applied to the focusing electrode 6, extends into the electrode through the single opening 62*d* of the second division electrode 62. In this case, however, the electron beam passing openings formed in the plate-like correction electrode 63 and in the inner electrode 64 arranged in the electrode have a diameter equal to, or slightly smaller than, the diameter D of the single opening 62*d* in the direction at right angles with the in-line direction. Therefore, the electric field reaches the deep portion of the electrode without almost any interruption.

In the electron gun of the embodiment shown in FIGS. 1A, 1B, 2A and 2B, on the other hand, the main lens electric field established by the anode voltage of the anode 7 and the focusing voltage of the focusing electrode 6 reaches the deep portion of the electrode through the single opening 62*d* in the second division electrode 62 while being affected by the plate-like correction electrode 63 and the inner electrode 64. However, the electron beam passing openings formed in the surface of the second division electrode 62 opposed to the first division electrode 61 have a diameter of about 4 mm, the diameter of the single opening 62*d* is about 8 mm in the direction at right angles with the in-line direction, the length L2 of the second division electrode 62 is shorter than the length shown in FIGS. 5A, 6A and 6B, and the diameter of the opening sharply decreases in this short region (length L2 of the second division electrode 62 of the present invention). Accordingly, the electric field cannot enter by the surface of the electrode having electron beam passing openings of a diameter of about 4 mm.

The electric field has the above-mentioned relationship in the second division electrode 62, whereas the electric field has a relationship as described below in the first division electrode 61. In the conventional electron gun shown in FIGS. 5A and 5B, the electron beam passing openings formed in the first division electrode 61 have a diameter of about 4 mm, whereas the length L of the first division electrode 61 in the axial direction of the tube is sufficiently larger than the diameter of about 4 mm. Besides, the second division electrode 62 has a potential equal to that of the first division electrode 61. Therefore, the electric field in the gap between the electrode in the conventional first division electrode 61 and the second division electrode 62, is mostly uniformly distributed from this gap into the electrode toward the fourth electrode 5 neighboring the cathode side. Therefore, the same holds for the state of the electric field in the gap between the first division electrode 61 and the second division electrode 62 in the electron gun of the embodiment of the present invention in which the length L1 of the first division electrode 61 in the axial direction of the tube is greater than that of the conventional electron gun.

When considering the speed of the electron beam in the above-mentioned electric field state, the section in which the electric field is uniform in the axial direction of the tube in the electron gun of the embodiment of the present invention is longer than that in the conventional electron gun. Therefore, the electron beam is not accelerated in this section. That is, the section in which the speed of the electron beam is relatively slow is long. This means that the electron beams receive much deflecting action from the electric field since the time for the electron beams to pass through the electric field generated by the speed-modulation coil is long. As a result, the effect of speed modulation is enhanced.

According to the above description, it may seem that the effect of speed modulation can be further enhanced if the length L2 of the second division electrode 62 is further reduced. However, a side effect occurs in that the electron beam passing openings 62*a*, 62*b* and 62*c*, formed in the surface of the second division electrode 62 opposed to the first division electrode 61, affect the equivalent diameter of the main lens, whereby the effect that the equivalent diameter is larger than that of the conventional main lens of the combination of cylinders is marred due to the single opening 62*d* and the plate-like correction electrode 63 disposed in the electrode, causing the beam spot diameter to increase at the center of the screen.

Figure 3:
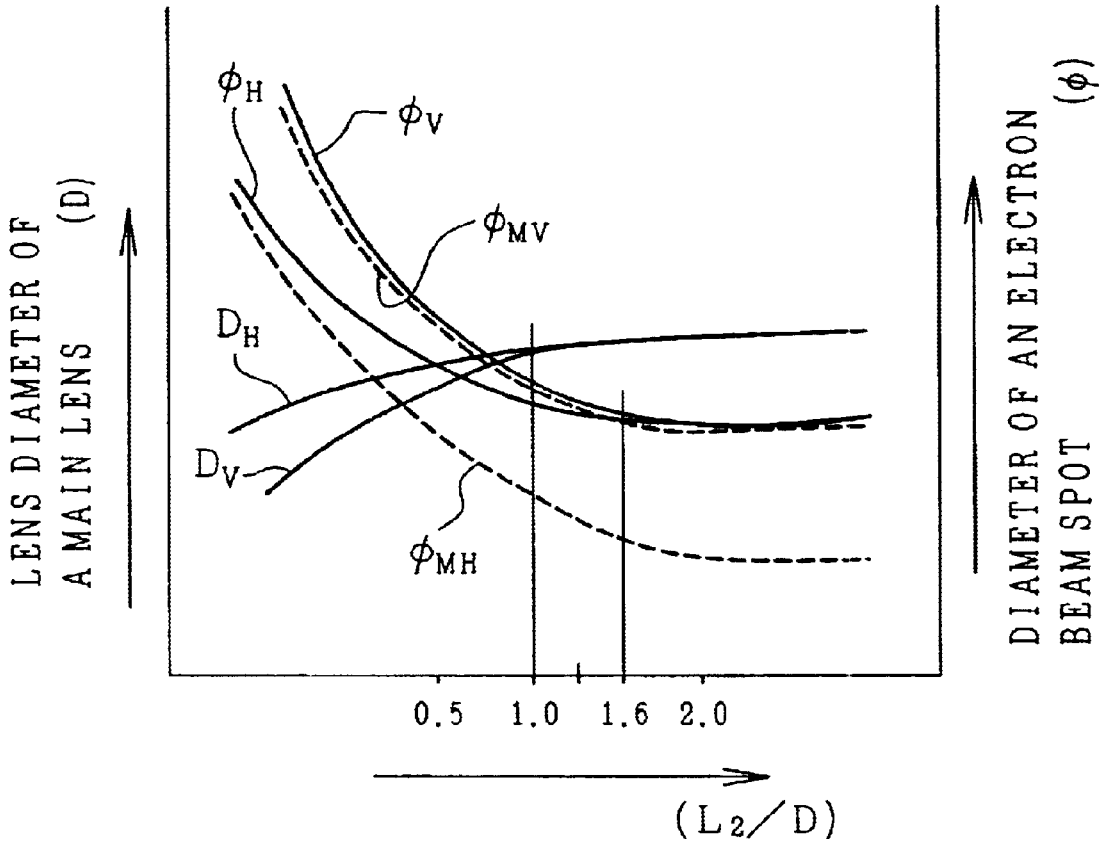
FIG. 3 is a graph illustrating the relationship of the change in the equivalent diameter of a main lens with the length of the second division electrode, the relationship of the change in the beam spot diameter with the length, and the relationship of the change in the beam spot diameter when the speed is modulated with the length.

FIG. 3 is a diagram illustrating the relationships of the change in the equivalent diameter of the main lens with the length of the second division electrode, a change in the beam spot diameter with the length of the second division electrode, and a change in the beam spot diameter when the speed is modulated with the length of the second division electrode, wherein DH and DV represent, respectively, the equivalent diameter of the main lens in the horizontal direction and the equivalent diameter of the main lens in the vertical direction, ϕH and ϕV represent, respectively, the beam spot diameter in the horizontal direction and the beam spot diameter in the vertical direction, and ϕMH and ϕMV represent, respectively, the beam spot diameter in the horizontal direction and the beam spot diameter in the vertical direction when the beam speed is modulated.

According to the study conducted by the present inventors, it has been found that when the length L2 of the second division electrode 62 is greater than the diameter D of the single opening 62*d* formed in this electrode in the direction at right angles with the in-line direction, the side effect is suppressed, i.e., the beam spot diameter does not increase with the decrease in the diameter of the main lens, and the effect due to the speed modulation is still exhibited.

Furthermore, one may consider an increase in the diameter of the electron beam passing openings 62*a*, 62*b* and 62*c* in order to weaken the effect of the electron beam passing openings. With an increase in the diameter, however, the electric field enters the gap between the first division electrode 61 and the second division electrode 62 or further the inside of the first division electrode 61. Therefore, the electron beams are accelerated, and the effect of the speed modulation decreases.

Moreover, the characteristics of the inner electrode 64 required for the main lens can be controlled without requiring high dimensional precision (see Japanese Patent Laid-open No. 126342/1992). As the length L2 of the second division electrode 62 is shortened, however, the circular shapes of the electron beam passing openings 32*a*, 62*b* and 62*c* affect the vertically elongated shape of the opening formed in the inner electrode 64, whereby the focusing action is intensified in a direction at right angles with the in-line direction. Therefore, the shapes of the beam spots on the screen tend to be transversely lengthened, and haloing occurs conspicuously above and below the beam spots in the periphery of the screen, deteriorating the resolution. By forming the electron beam passing opening which is elongated in the in-line direction in the shield cup 8 that is connected to the anode 7, however, the diverging action is weakened in the in-line direction. This suppresses the increase of the horizontal size of the beam spot shape on the screen, and prevents the resolution from being deteriorated in the periphery of the screen.

Figure 1C:
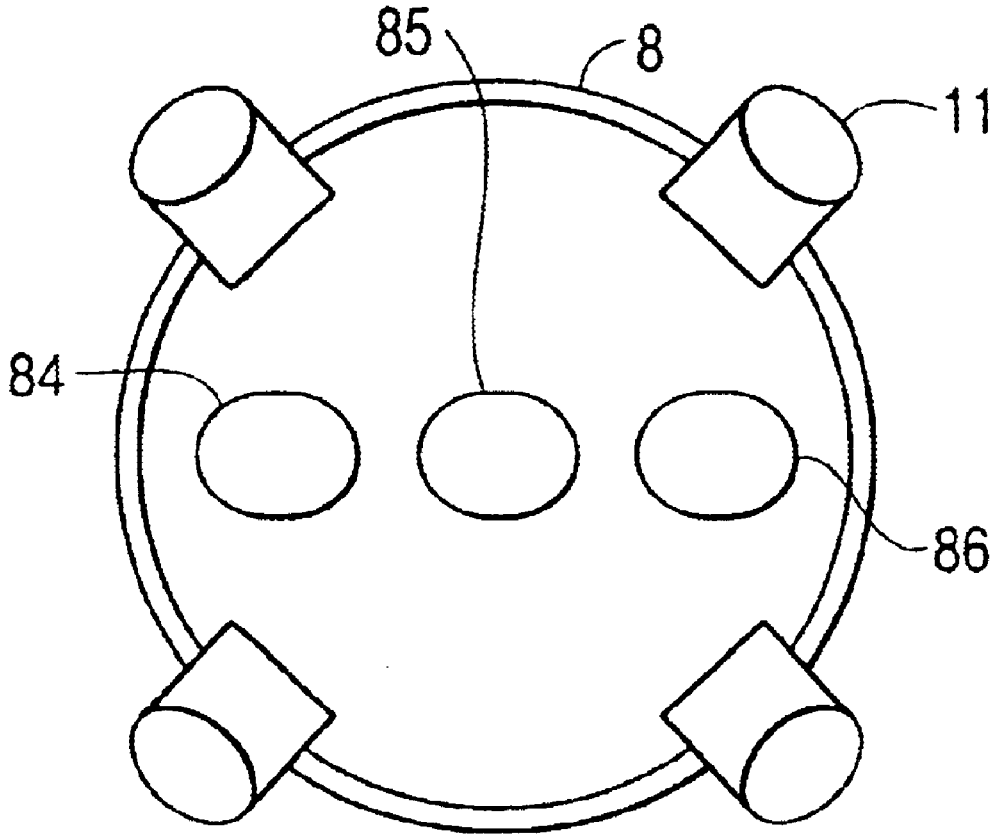

As shown in FIGS. 1A and 1B, the shield cup has a single opening. However, independent openings 84, 85 and 86 elongated in the in-line direction may be formed for the respective electron beams as shown in FIG. 1C.

According to the study conducted by the present inventors, furthermore, no change in the effect of the speed modulation was observed when the length L2 of the second division electrode 62 was increased to a value longer than about 1.6 times that of the diameter D of the single opening in this electrode in the direction at right angles with the in-line direction. This is because the position of the gap between the division electrodes for speed modulation is located away from the main lens, and the space of the main lens electric field is expanded correspondingly. Therefore, the deflection of the electron beams by the speed modulation coil is canceled by the focusing action of the main lens electric field. Therefore, the effect of speed modulation of the electron beams accelerated by the main lens electric field entering the inside of the second division electrode 62 through the single opening 62*d* is exhibited outside the area that can be viewed on the screen.

An electron gun of the non-dynamic focus (non-DF) type having a fixed focusing voltage has been described above. The same, however, also holds for an electron gun of the dynamic focus (DF) type, in which the focusing voltage changes dynamically. The electron gun of the DF type uses two kinds of focusing voltages, the difference therebetween being about 3 kV at the greatest. The speed of the electron beams accelerated by the voltage difference of about 3 kV, however, is still slower than the speed of the beams accelerated by the voltage difference between the anode voltage and the focusing voltage.

In the electron gun of the DF system, in general, a voltage that dynamically changes is applied to an electrode opposed to the anode. Based on the constitution of the electron gun shown in FIG. 1, therefore, a focusing voltage that dynamically changes is applied to the second division electrode 62, a fixed focusing voltage is applied to the first division electrode 61, and the length L2 of the second division electrode 62 is determined to be from about 1.0 to about 1.6 times as great as the diameter D of the single opening 62*d* in the direction at right angles with the in-line direction, in order to improve the effect of speed modulation.

According to the present invention, as described above, it is possible to improve the effect of speed modulation in the electron gun for a color cathode ray tube having a main lens of a structure with a single opening and independent electron beam passing openings for the respective electron beams in the electrode, and to maintain desired characteristics of the main lens by the conventional method.

What is claimed is:

1. A color cathode ray tube, comprising:

at least an envelope constituted by a panel portion, a neck portion and a funnel portion connecting the panel portion and the neck portion;

an electron gun contained in the neck portion, constituted by a cathode for forming a plurality of electron beams arranged in-line, and a focusing electrode and an anode constituting a main lens for focusing and accelerating said electron beams;

a fluorescent screen formed on an inner surface of the panel portion;

a deflecting device provided so as to surround a transition region between the funnel portion and the neck portion; and a speed-modulation coil for controlling a scanning speed of said electron beams;

wherein said focusing electrode and said anode are arranged in order from said cathode side toward said fluorescent screen side in an axial direction of the tube;

said focusing electrode includes at least a first division electrode and a second division electrode arranged with a gap in the axial direction of the tube;

said second division electrode is opposed to said anode and has, in an opposed surface thereof, a single opening for passing said plurality of electron beams in common;

a length of said first division electrode in the axial direction of the tube is longer than a length of said second division electrode in the axial direction of the tube;

the length of said second division electrode in the axial direction of the tube is within a range of from about 1.0 to 1.6 times the diameter of said single opening in the surface of said second division electrode in a direction at right angles with the in-line direction; and said speed-modulation coil is installed so as to surround the neck portion of the envelope of said color cathode ray tube where at least said first division electrode and said second division electrode of said focusing electrode of said electron gun are disposed.

2. A color cathode ray tube according to claim 1, wherein said second division electrode is opposed to said first division electrode and has, in an opposed surface thereof, individual electron beam passing openings for the respective electron beams.

3. A color cathode ray tube according to claim 2, wherein a diameter of said individual electron beam passing openings in the surface of said second division electrode opposed to said first division electrode is smaller than a diameter of said single opening in the surface of said second division electrode opposed to said anode in a direction at right angles with the in-line direction.

4. A color cathode ray tube according to claim 2, wherein individual electron beam passing openings for the respective electron beams are provided in at least two positions in said second division electrode in the axial direction of the tube.

5. A color cathode ray tube according to claim 4, wherein one of said two positions of said individual electron beam passing openings is provided at a position opposing to said first division electrode; and the position of said individual electron beam passing openings opposing to said first division electrode is provided from said single opening within a range of about 1.6 times of the diameter of said single opening as defined in a diameter direction at a right angle with the in-line direction.

6. A color cathode ray tube according to claim 1, wherein said first division electrode is opposed to said second division electrode and has, in an opposed surface thereof, individual electron beam passing openings for the respective electron beams.

7. A color cathode ray tube according to claim 6, wherein a diameter of said individual electron beam passing openings in the surface of said first division electrode opposed to said second division electrode is smaller than a diameter of said single opening in the surface of said second division electrode opposed to said anode in a direction at right angles with the in-line direction.

8. A color cathode ray tube according to claim 1, wherein a focusing voltage that dynamically changes is applied to said second division electrode.

9. A color cathode ray tube according to claim 8, wherein differences between another focusing voltage applied to said first division electrode and said focusing voltage applied to said second division electrode are about 3 kV at the greatest.

10. A color cathode ray tube according to claim 1, wherein said speed-modulation coil surrounds said neck portion and extends in the axial direction of the tube in the region of said first division electrode and said second division electrode of said focusing electrode and said anode of said electron gun.

* * * * *